United States Patent [19]

Lang

[11] Patent Number: 5,027,450

[45] Date of Patent: Jul. 2, 1991

[54] EXTENDIBLE AND RETRACTABLE SPA JET

[76] Inventor: Harold Lang, 8027 Twin Hills, Houston, Tex. 77071

[21] Appl. No.: 383,670

[22] Filed: Jul. 21, 1989

[51] Int. Cl.[5] ..... A61H 33/02

[52] U.S. Cl. ..... 4/542; 4/568; 4/570; 239/197

[58] Field of Search ..... 4/490, 491, 492, 494, 4/496, 541, 542, 543, 544, 546, 567, 568, 570, 605; 239/197, 588; 128/66

[56] References Cited

U.S. PATENT DOCUMENTS

| | | | |
|---|---|---|---|
| 2,772,421 | 12/1956 | Friend | 4/544 |
| 3,182,336 | 5/1965 | Greuter | 4/570 |
| 3,806,964 | 4/1974 | Vanegas et al. | 4/542 |
| 4,144,898 | 3/1979 | Guignon et al. | 239/197 X |
| 4,424,598 | 1/1984 | Cima | 4/541 X |
| 4,449,260 | 5/1984 | Whitaker | 4/490 |
| 4,458,676 | 7/1984 | Pileggi | 128/66 X |

FOREIGN PATENT DOCUMENTS

| | | | |
|---|---|---|---|
| 119581 | 9/1984 | European Pat. Off. | 4/542 |
| 305809 | 6/1917 | Fed. Rep. of Germany | 4/542 |
| 19974 | 12/1915 | France | 4/544 |
| 459502 | 1/1937 | United Kingdom | 4/570 |
| 766508 | 1/1957 | United Kingdom | 239/197 |

*Primary Examiner*—Henry J. Recla
*Assistant Examiner*—R. M. Fetsuga
*Attorney, Agent, or Firm*—Kenneth A. Roddy

[57] ABSTRACT

An extendible and retractable spa jet in the retracted position resides in the side wall of a spa or tub and is connected to, and operated by, the existing pressurized water and/or air supply. In the retracted position it serves as a conventional fixed jet. When desired, it may be pulled outwardly from the side wall of the enclosure and used as a hand-held massage device to achieve concentrated, intensified massaging action at localized areas of the body not possible with fixed spa jets.

14 Claims, 2 Drawing Sheets

EXTENDIBLE AND RETRACTABLE SPA JET

BACKGROUND OF THE INVENTION

1. Field of the Invention

This invention relates generally to water massage devices, and more particularly to an extendible and retractable spa jet which in the retracted position resides in the side wall of a spa or tub and may be pulled outwardly therefrom to be used as a hand-held massage device.

2. Brief Description of the Prior Art

Hot tubs and spas are well known for injecting aerated streams of water that have a therapeutic massaging effect on the body of the occupant. The therapeutic action of the tubs or spas is achieved by the vibrating action of bubbles and forceful circulation of water produced by jet nozzles positioned in the side walls of the spa or tub. However, the location of these jets allows the occupant to juxtapose primarily the back of the neck, shoulders, and back to the jets and, for the most part makes it impossible to achieve concentrated, intensified massaging action at other localized areas of the body.

Hand-held water sprayer heads and fluid powered vibrating heads which connect to faucets of household water systems are also known, but they are not particularly suited for operation or use in a submerged body of water.

There are several patents which disclose various massage devices for use in spas or hot tubs.

Sievers, U.S. Pat. No. 4,313,432 discloses a water driven personal massager for use in spas, hot tubs and the like which is connected to and driven vibrationally by the pressurized water supply of the spa or tub. The device comprises a conduit for connection to the pressurized water supply, a nozzle to direct the pressurized water across an eccentrically weighted turbine or waffle plate within a hand holdable massager head.

Marshall, U.S. Pat. No. 4,430,762 discloses an aquassage apparatus comprising a length of perforated bendable tubing having suction cups secured to the bottom which is installed in conventional bath tubs. The exhaust port of a vacuum cleaner is connected at one end of the tubing and controlled by a valve to agitate the water in the tub.

Pileggi, U.S. Pat. No. 4,458,676 discloses a portable hand held massager in combination with a spa. The massager has a fluid motor that is mechanically connected to a reciprocating massage pad. The fluid motor is detachably connected to the pressurized fluid system of the spa, and has a sleeve adapter to attach to a jet nozzle in the wall of the spa with a flexible hose leading to the motor of the massage unit.

Stearns, III, U.S. Pat. No. 4,640,462 discloses a hand-held water driven shower massager which includes a housing having an internally disposed rotatable nozzle which is caused to rotate by the high velocity discharge of water from the nozzle. An oscillating vibrational motion is applied to the entire device by eccentrically weighting the discharge nozzle, and provides a massaging effect when pressed against the body of the user. When held away from the user, the unit functions as a source of water spray for cleansing.

The present invention is distinguished over the prior art in general, and these patents in particular by an extendible and retractable spa jet which is connected to, and operated by, the existing pressurized water supply.

In the retracted position, the jet resides in the side wall of a spa or tub and serves as a conventional fixed jet. When desired, it may be pulled outwardly from the side wall of the enclosure and used as a hand-held massage device to achieve concentrated, intensified massaging action at localized areas of the body not possible with fixed spa jets.

SUMMARY OF THE INVENTION

It is therefore an object of the present invention to provide an extendible and retractable spa jet which in the retracted position resides in the side wall of a spa or tub to serve as a conventional fixed jet and may also be pulled outwardly therefrom to be used as a hand-held massage device.

It is another object of this invention to provide an extendible and retractable spa jet which is operated by the existing pressurized water supply of a spa or tub.

Another object of this invention is to provide a extendible and retractable spa jet is easily installed in the side wall of a spa or tub and connected to the existing pressurized water supply by simple connections.

A further object of this invention is to provide an extendible and retractable spa jet which makes it possible to achieve concentrated, intensified massaging action at localized areas of the body not possible with fixed spa jets.

A still further object of this invention is to provide an extendible and retractable spa jet which is simple in design and construction, economical to manufacture, and rugged and durable in use.

Other objects of the invention will become apparent from time to time throughout the specification and claims as hereinafter related.

The above noted objects and other objects of the invention are accomplished by an extendible and retractable spa jet which is connected to, and operated by, the existing pressurized water supply. In the retracted position, the jet resides in the side wall of a spa or tub and serves as a conventional fixed jet. When desired, it may be pulled outwardly from the side wall of the enclosure and used as a hand-held massage device to achieve concentrated, intensified massaging action at localized areas of the body not possible with fixed spa jets.

DESCRIPTION OF THE PREFERRED EMBODIMENT

The present extendible and retractable spa jet is installed in spas or tubs of conventional construction with a side wall and a bottom wall and has a plurality of openings in the side wall to receive conventional fluid jet nozzles which communicate with one or more fluid distribution conduits. The spa or tub also includes a water circulation system conventional in the art. The typical spa or tub water circulation system includes a return line from a drain or outlet of the tub enclosure which leads to a pump. The pump discharge is connected to the water distribution conduit which is in open communication with each of the plurality of conventional jet nozzles. In most conventional spa or tub water circulation systems, air is introduced into the pressure water line prior to the discharge of the water as a jet into the spa. In some systems, air is inducted into the nozzle by the Venturi principle and in other systems, air may be supplied with a blower.

It should be understood that the spa or tub may utilize one or more extendible and retractable jets, as described hereinafter, in combination with conventional fixed jets or may utilize all extendible and retractable jets.

Figure 2:
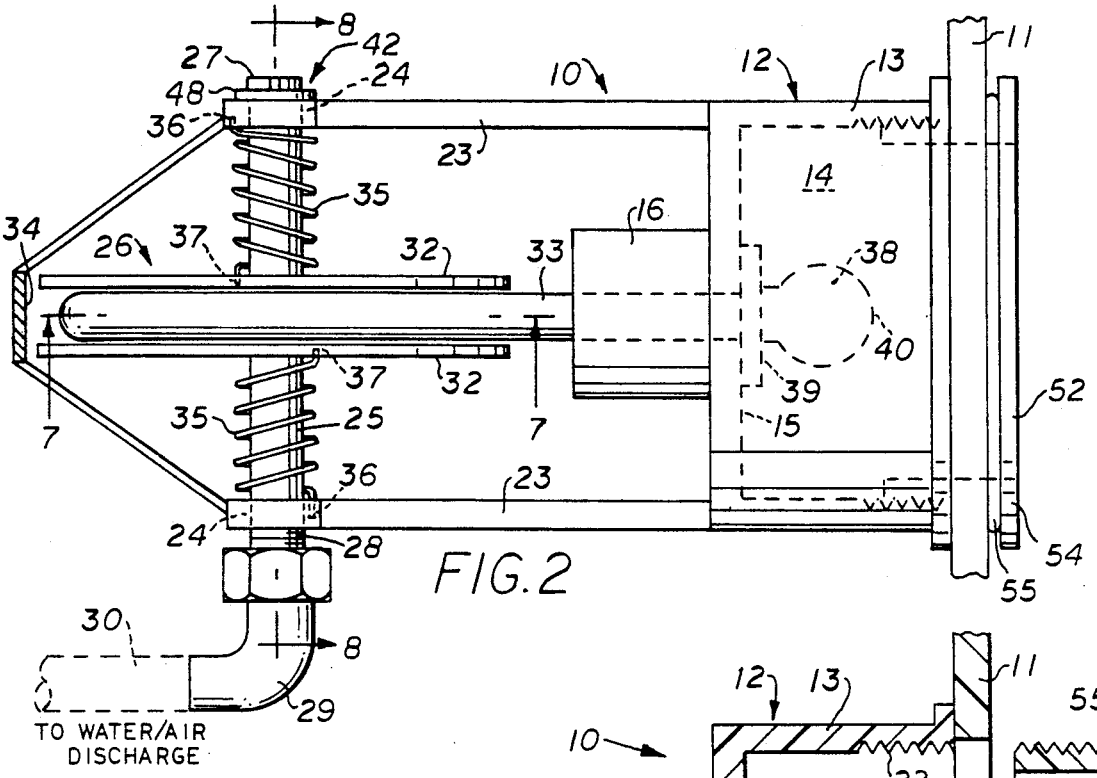
FIG. 2 is a top plan view of the extendible and retractable spa jet of FIG. 1.
Figure 1:
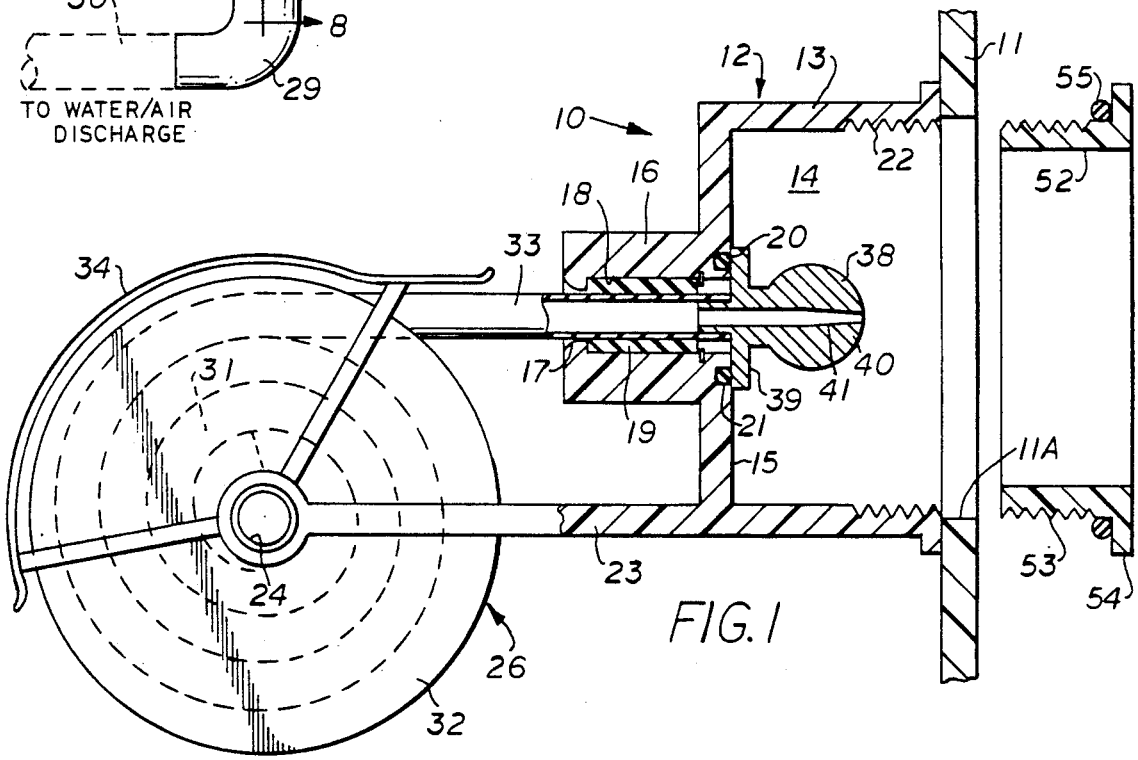
FIG. 1 is a side elevation in partial cross section of an extendible and retractable spa jet in accordance with the present invention.
Figure 3:
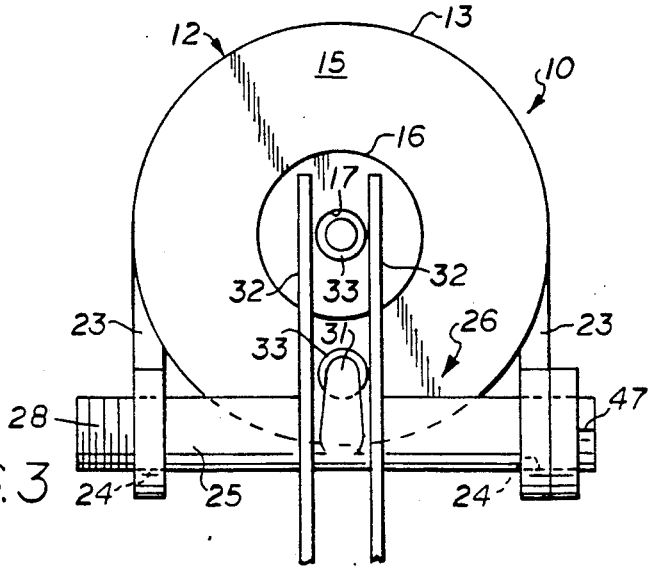
FIG. 3 is a rear view of the extendible and retractable spa jet of FIG. 1, with the hose, hood, and springs removed.

Referring to the drawings by numerals of reference, there is shown in FIGS. 1, 2 and 3, a preferred extendible and retractable spa jet 10 attached to the side wall 11 of a spa or tub such as described above. The extendible and retractable spa jet 10 comprises a generally cup-shaped housing 12 having a generally cylindrical side wall 13 with a cylindrical cavity 14 which extends inwardly from one end and terminates in a back wall 15. A reduced diameter portion 16 extends rearwardly from the back wall 15. A bore 17 extends longitudinally through the back wall 15 and reduced diameter extension 16 and is counterbored a distance from the back wall end. An elastomeric seal element 19 is installed in the counterbore 18 and another seal element 20 may be installed in a ring groove 21 on the cavity side of the back wall 15. The forward end of the cavity is provided with internal threads 22. The rearward end of the bore 17 may be rounded.

Figure 4:
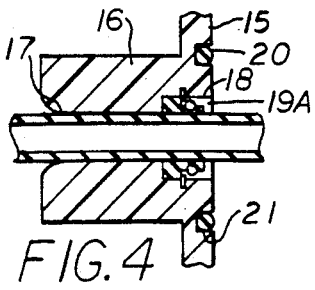
FIGS. 4, 5, and 6 are partial cross section views showing alternate seal elements.
Figure 5:
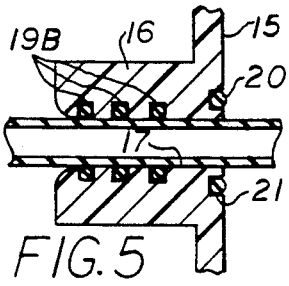
Figure 6:
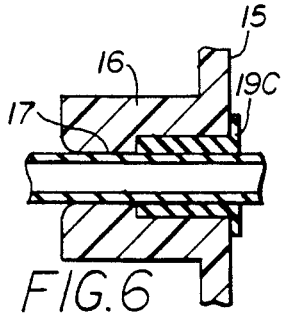

Although a single elastomeric seal element 19 is shown in FIG. 2, various other seal arrangements may be utilized. For example, FIG. 4, illustrates a spring resilient wiper type seal 19A. FIG. 5 shows a plurality of O-ring seal elements 19B, and FIG. 6 shows a single elastomeric seal element having a radial flange or lip portion engaged on the cavity side of the back wall 15.

A pair of laterally spaced arms 23 extend longitudinally from the back wall 15 of the housing 12. The extended ends of the arms 23 have axially aligned holes 24 therethrough which rotatably receive the tubular shaft 25 of a reel 26.

Figure 7:
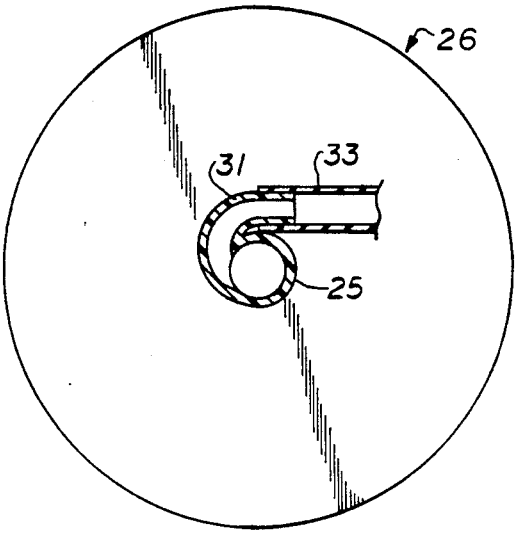
FIG. 7 is a cross section of the reel of the extendible and retractable spa jet taken along line 7—7 of FIG. 2.
Figure 8:
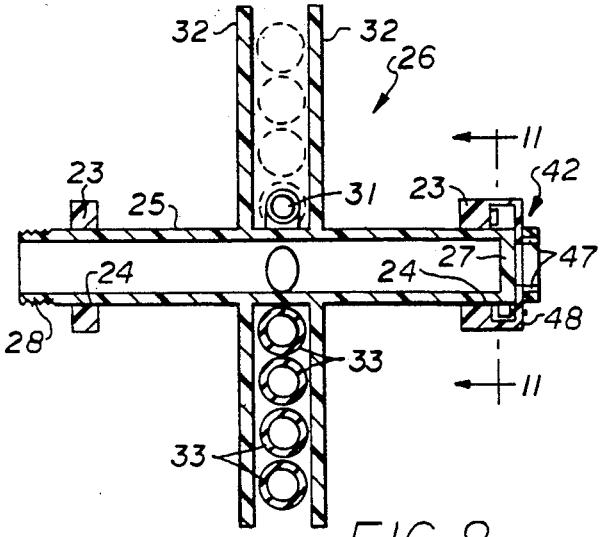
FIG. 8 is a cross section of the reel of the extendible and retractable spa jet taken along line 8—8 of FIG. 2.

Referring additionally to FIGS. 7 and 8, the shaft 25 of the reel 26 is hollow and enclosed at one end by an end wall 27. The opposite end of the reel shaft 25 is open and provided with threads 28 or otherwise adapted to receive a swivel connection fitting 29. A length of conduit 30 is connected to the swivel fitting 29 and extends outwardly therefrom and is adapted at its outer end for connection to the existing water/air discharge conduit of the existing water circulation system. A hollow outlet conduit or passageway 31 extends spirally from the center of the shaft 25 in fluid communication with the interior of the shaft. A pair of parallel radial flanges 32 are spaced laterally to each side of the outlet passageway or conduit 31.

A flexible hose 33 is connected at one end to the outlet conduit 31 and is spirally wound on itself within the flanges 32. The outer end of the flexible hose 33 is slidably received through the bore 17 in the housing back wall 15 and through the seal 19 to engage the seal 19 in a reciprocating sealing relation. In other words, the seal 19 will allow the hose 33 to slide relative thereto while preventing liquid from escaping from the spa or tub enclosure through the hose passageway.

The arms 23 are preferably disposed below the axial center of the cylindrical extension 16 such that the outer end (or top convolution) of the flexible hose 33 will spool off the reel 26 and pass through the bore 17 and seal 19 in a generally axially aligned relation to prevent binding. The rounded rearward end of the bore 17 also prevents binding. The cylindrical extension 16 supports the hose 33 and facilitates guiding it on and off the reel 26.

A generally semi-circular cover or hood 34 may also be provided to extend partially over the top portion of the reel 26 to aid in guiding and maintaining the hose 33 on the reel during the spooling operation, and prevent the hose from coming off track.

A pair of coiled springs 35 are received on the shaft 25 one at each side of the radial flanges 32. One end of each spring 34 is received in an aperture 36 in each arm 23 and the other end of each spring is received in an aperture 37 in each radial flange 32. The springs 35 are secured such that the hose 33 is spring biased in a normally retracted wound position, and when pulled outward will spool off the reel 26 as the reel rotates.

A nozzle 38 is secured to the free end of the hose 33. The nozzle 38 preferably has a flat radial flange 39 at its connection with the hose 33 and a rounded exterior 40 which is configured to be easily gripped by the hand of the user. A bore 41 extends through the nozzle 38 in communication with the hose interior. The nozzle bore 41 may be tapered toward its outer end to expel the liquid or air passing therethrough forcefully in a jet stream of liquid and/or air. The flat flange 39 of the nozzle 38, in the retracted position, will sealingly engage the seal element 20 installed on the cavity side of the back wall 15 to further prevent liquid from escaping from the spa or tub enclosure through the hose passageway.

A centrifugal latch mechanism 42 may be installed between the reel 26 and the arms 23 to maintain the nozzle 38 in a selective outwardly extended position. It should be understood that various conventional latching mechanisms may be adapted to control the extended position of the nozzle, and the following description is but one example of a simple ratchet latch mechanism.

Figure 9:
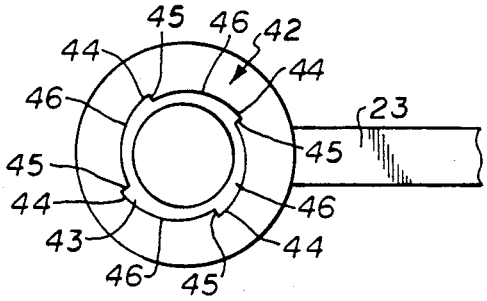
FIG. 9 is an elevation view of a portion of one arm of the spa jet housing showing the ratchet ring element of the latch mechanism.
Figure 11:
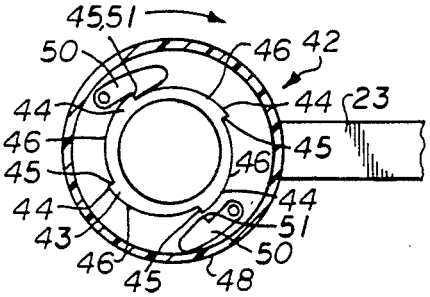
FIG. 11 is a partial cross section of the ratchet ring and cover of the latch mechanism in the assembled condition taken along line 11—11 of FIG. 8.
Figure 10:
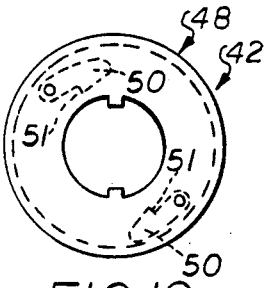
FIG. 10 is an elevation of the cover element of the latch mechanism.

Referring now to FIGS. 9–11, the outward side of one of the reel supporting arms 23 is provided with a raised stop member or stationary ratchet ring 43 which encircles the shaft receiving hole 24. The ratchet ring 43 has a plurality of radially extending toothed surfaces 44 which are flat 45 on the counterclockwise side as seen in FIGS. 9 and 11 and curved 46 on the opposite or clockwise side. The enclosed end 27 of the shaft 25 which is received through the hole 24 is provided with a pair of circumferentially spaced keyways or slots 47. A cup-shaped cover or cap 48 has a central aperture having tabs 49 corresponding to the keyway or slot configuration of the end 27 of the shaft 25 and is secured thereon to rotate with the reel 26 as the hose 33 is spooled on and off. A pair of pawls 50 are pivotally mounted within the cap 48 in circumferentially spaced relation. The free ends of the pawls 50 are shaped to ride on the curved surfaces 46 of the ratchet ring 43 when the reel 26 rotates in one direction (spooling off), and are provided with a flat surface 51 which will engage the flat surfaces 45 of the ratchet ring 43 when the reel rotates in the opposite direction (retracting).

When the nozzle 38 is pulled slowly outward from the housing 12, the hose 33 will spool off the reel 26 and gravity drops the free end of the lowermost pawl 50 out of engagement with the ratchet ring 43 and the free end of the topmost pawl will ride over the curved surfaces 46 of the ratchet ring 43. When tension on the hose 33 is released, the springs 35 cause the reel 26 to rotate in the opposite direction (retract), and the flat surface 51 of the topmost pawl 50 will engage the flat surfaces 45 of the ratchet ring 43 to prevent further rotation. When the nozzle 38 is pulled out and quickly released, the pawls 50 pivot radially outward and disengage from the ratchet ring flat surfaces due to centrifugal force, allowing the hose and nozzle to be fully retracted to its stored position.

Referring again to FIGS. 1 and 2, a trim ring 52 is provided for securing the housing 12 onto the side wall 11 of the tub or spa. The trim ring 52 is a hollow cylindrical member having external threads 53 and a radially extending flange 54 and a seal element 55 therebetween. The housing 12 is placed on the exterior of the tub enclosure side wall 11 in axial alignment with the existing jet nozzle openings 11A. If nozzle openings do not exist in the side wall, then they may be formed therein by conventional methods. The trim ring 52 is threadedly engaged with the internal threads 22 of the housing cavity 14 and tightened to engage the seal element 54 with the interior surface of the tub side wall 11. The conduit 30 leading from the swivel fitting 29 is then connected to the existing water/air discharge conduit of the existing water circulation system.

OPERATION

It should be understood from the foregoing description that the extendible and retractable spa jet in the retracted position resides in the side wall of a spa or tub and is connected to, and operated by, the existing pressurized water supply. In the retracted position it serves as a conventional fixed jet. When desired it may be pulled outwardly from the side wall of the enclosure and used as a hand-held massage device to achieve concentrated, intensified massaging action at localized areas of the body not possible with fixed spa jets.

While this invention has been described fully and completely with special emphasis upon a preferred embodiment, it should be understood that within the scope of the appended claims the invention may be practiced otherwise than as specifically described herein.

I claim:

1. An extendible and retractable jet apparatus for use in hydrotherapy tubs of the type having at least one side wall, a normal water level therein and a pressurized fluid distribution system including a discharge conduit, the jet apparatus comprising;

a housing adapted for connection to the exterior side of the existing side wall of the hydrotherapy tub over an aperture formed therein below the normal water level and said housing having a cavity at one end and a longitudinal bore extending through the housing, fluid seal means surrounding the aperture in the side wall for preventing fluid leakage therearound, hose storage means on said housing for receiving and dispensing a length of flexible hose, a length of flexible hose adapted to be connected at one end to the discharge conduit of the pressurized fluid distribution system of the hydrotherapy tub and in fluid communication therewith, the free end of said length of flexible hose in a stored position being contained within said housing cavity and capable of being extended outwardly a distance therefrom in an extended position within the hydrotherapy tub, a nozzle member secured to the free end of said length of flexible hose and adapted to be received and engaged in said housing cavity in the stored position and configured to expel fluid passing therethrough forcefully in a jet stream of fluid, whereby said nozzle member in the stored position within said housing cavity resides adjacent the interior of the side wall of the hydrotherapy tub and operates as a fixed jet and may be manually pulled outwardly therefrom to the extended position and used as a hand-held massage device to achieve concentrated, intensified massaging action at localized areas of the body of an occupant of the hydrotherapy tub.

2. An extendible and retractable jet apparatus according to claim 1 wherein said hose storage means extends outwardly from the side wall.

3. An extendible and retractable jet apparatus according to claim 1 wherein said hose storage means is movable relative to said housing to receive and dispense a length of flexible hose.

4. An extendible and retractable jet apparatus according to claim 3 wherein said hose storage means comprises a spring retractable reel and said length of flexible hose is wound thereon in the stored position and spooled therefrom to the extended position.

5. An extendible and retractable jet apparatus according to claim 4 wherein said retractable reel is rotatably mounted on said housing, and said length of flexible hose extends reciprocally through said bore and said cavity of said housing.

6. An extendible and retractable jet apparatus according to claim 5 including fluid seal means in said housing bore surrounding said length of flexible hose in a reciprocating fluid sealing relation for preventing fluid leakage therearound.

7. An extendible and retractable jet apparatus according to claim 5 including fluid seal means disposed between said nozzle member and said housing cavity surrounding said housing bore in a fluid sealing relation when said nozzle is received and engaged in said housing cavity in the stored position for preventing fluid leakage through said cavity.

8. An extendible and retractable jet apparatus according to claim 4 wherein said retractable reel has a hollow shaft having an inlet end adapted to be connected to the discharge conduit of the pressurized fluid distribution system of the hydrotherapy tub and in fluid communication therewith and a fluid outlet member, and said one end of said length of flexible hose is connected in fluid communication with said outlet member and will conduct fluid therethrough both in the stored position wound on said reel and in the extended position.

9. An extendible and retractable jet apparatus according to claim 8 wherein said housing has a pair of laterally spaced projections, and said retractable reel hollow shaft is rotatably supported thereon.

10. An extendible and retractable jet apparatus according to claim 8 including guide means on said housing disposed relative to said housing bore for guiding said flexible hose on and off said reel and to prevent binding of said flexible hose as it moves between the extended and stored positions.

11. An extendible and retractable jet apparatus according to claim 8 including hood means extending partially around the exterior of said reel to aid in guiding and maintaining said length of flexible hose on said reel during the spooling operation.

12. An extendible and retractable jet apparatus according to claim 8 including at least one spring member operatively mounted between said housing and said reel such that said length of flexible hose is spring biased in a normally retracted wound position on said reel and when pulled outward will spool off said reel as said reel rotates.

13. An extendible and retractable jet apparatus according to claim 8 including releasable latch means operatively connected between said housing and said reel such that the free end of said length of flexible hose may be releasably maintained in a selective extended position.

14. In combination with a hydrotherapy tub of the type having at least one side wall forming an enclosure for containing a body of water at a normal water level and a pressurized fluid distribution system fluidly connected to the enclosure and to a pressurized fluid source for circulating fluid into the body of water;

at least one fluid jet extendibly and retractably received in a housing mounted over an aperture formed in said enclosure side wall below the normal water level and including a length of flexible hose connected at one end in fluid communication with said pressurized fluid distribution system and a nozzle member at its free end configured to forcefully expel fluid passing therethrough in a jet stream of fluid, fluid seal means surrounding the aperture in the side wall for preventing fluid leakage therearound, and said nozzle member being manually movable between a stored position within said housing residing adjacent the interior of the side wall of the enclosure to operate as a fixed jet and an extended position outwardly from said side wall to be used as a hand-held massage device to achieve concentrated, intensified massaging action at localized areas of the body of an occupant of the enclosure.

* * * * *